US008412057B2

(12) United States Patent
Niijima

(10) Patent No.: US 8,412,057 B2
(45) Date of Patent: Apr. 2, 2013

(54) IMAGE FORMING CARTRIDGE, IMAGE FORMING APPARATUS AND TONER CARTRIDGE

(75) Inventor: Yoshio Niijima, Tokyo (JP)

(73) Assignee: Oki Data Corporation, Tokyo (JP)

( * ) Notice: Subject to any disclaimer, the term of this patent is extended or adjusted under 35 U.S.C. 154(b) by 806 days.

(21) Appl. No.: 12/241,297

(22) Filed: Sep. 30, 2008

(65) Prior Publication Data

US 2009/0142078 A1 Jun. 4, 2009

(30) Foreign Application Priority Data

Nov. 30, 2007 (JP) ..... 2007-309602

(51) Int. Cl.
*G03G 15/08* (2006.01)

(52) U.S. Cl. ..... 399/27; 399/12; 399/50; 399/262; 399/263

(58) Field of Classification Search ..... 399/27, 399/50, 120, 258, 262, 263
See application file for complete search history.

(56) References Cited

U.S. PATENT DOCUMENTS 5,307,124 A * 4/1994 Stelter ..... 399/62
6,339,689 B1 * 1/2002 Sugiura ..... 399/120
7,065,306 B2 * 6/2006 Akashi et al. ..... 399/27
7,787,782 B2 * 8/2010 Takada ..... 399/12
2003/0123888 A1 * 7/2003 Naito et al. ..... 399/27
2003/0210929 A1 * 11/2003 Ota et al. ..... 399/262
2004/0265010 A1 * 12/2004 Otani ..... 399/258
2005/0244173 A1 * 11/2005 Akashi et al. ..... 399/27
2006/0216046 A1 * 9/2006 Hatakeyama ..... 399/27

FOREIGN PATENT DOCUMENTS

JP 11-084840 A 3/1999
JP 11-272056 A 10/1999
JP 2002-258676 A 9/2002
JP 2006-154235 A 6/2006
JP 2007-094343 A 4/2007
JP 2007-271895 A 10/2007

* cited by examiner

*Primary Examiner* — David Gray
*Assistant Examiner* — Francis Gray
(74) *Attorney, Agent, or Firm* — Marvin A. Motsenbocker; Mots Law, PLLC

(57) ABSTRACT

An image forming cartridge comprises a developing unit configured to hold toner including a developing section configured to use the toner for developing and a supplying section configured to provide the toner to the developing section and a toner cartridge attachable to the developing unit, wherein the toner cartridge contains toner and supplies toner to the developing unit and the toner cartridge includes a stand-by charging unit configured to perform stand-by charge to the toner in the toner cartridge.

21 Claims, 16 Drawing Sheets

CONFIGURATIONAL DIAGRAM OF CONTROL SYSTEM OF IMAGE FORMING APPARATUS OF FIRST EMBODIMENT

CONFIGURATIONAL VIEW OF IMAGE FORMING APPARATUS OF FIRST EMBODIMENT

CONFIGURATIONAL VIEW OF IMAGE FORMING CARTRIDGE OF FIRST EMBODIMENT

CROSS-SECTIONAL VIEW OF DEVELOPING UNIT AND CARTRIDGE OF FIRST EMBODIMENT

CONFIGURATIONAL VIEW OF STIRRER OF IMAGE FORMING APPARATUS OF FIRST EMBODIMENT

CONFIGURATIONAL DIAGRAM OF CONTROL SYSTEM OF IMAGE FORMING APPARATUS OF FIRST EMBODIMENT

OPERATIONAL ILLUSTRATION OF IMAGE FORMING APPARATUS OF FIRST EMBODIMENT

OPERATIONAL ILLUSTRATION OF IMAGE FORMING APPARATUS OF FIRST EMBODIMENT

Tk : OPERATION TIME OF STIRRING BAR
Tsum : TOTAL OPERATION TIME OF STIRRING BAR

OPERATION FLOWCHART OF IMAGE FORMING APPARATUS OF FIRST EMBODIMENT

CROSS-SECTIONAL VIEW SHOWING CONFIGURATION OF DEVELOPING UNIT OF SECOND EMBODIMENT

TONER LEVEL DETECTOR OF IMAGE FORMING APPARATUS OF SECOND EMBODIMENT

CONFIGURATIONAL DIAGRAM OF CONTROL SYSTEM OF IMAGE FORMING APPARATUS OF SECOND EMBODIMENT

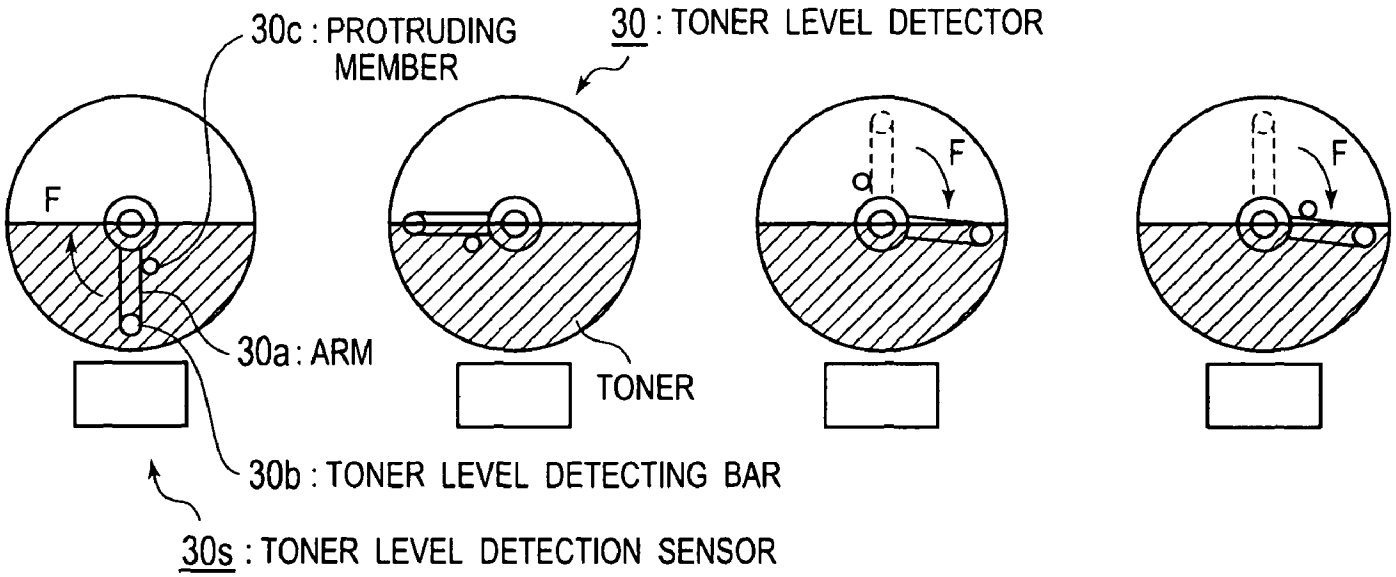
OPERATIONS WHEN TONER LEVEL IS HIGH
ILLUSTRATION OF DETECTING OPERATIONS OF TONER AMOUNT IN IMAGE FORMING APPARATUS OF SECOND EMBODIMENT

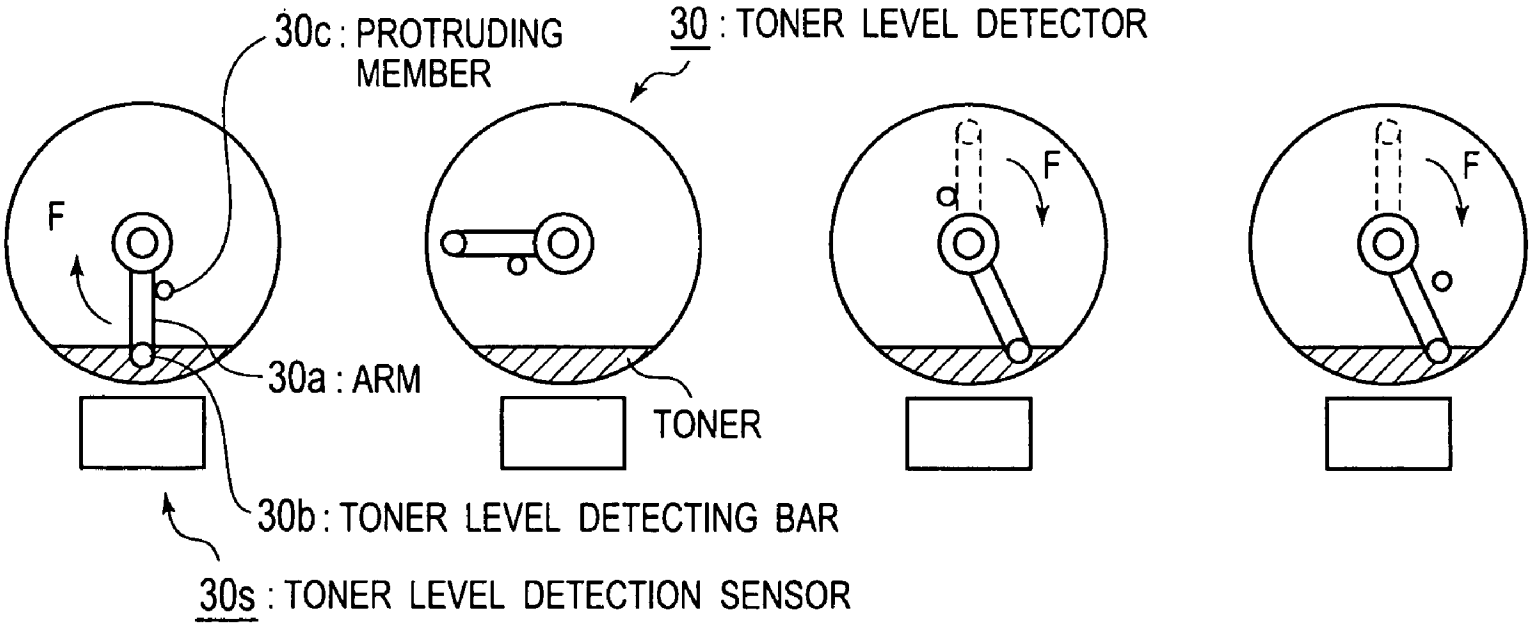
ILLUSTRATION OF DETECTING OPERATIONS OF TONER AMOUNT IN IMAGE FORMING APPARATUS OF SECOND EMBODIMENT

SENSOR OUTPUT WHEN TONER LEVEL IS HIGH

SENSOR OUTPUT WHEN TONER LEVEL IS LOW

SENSOR OUTPUT WAVEFORM OF IMAGE FORMING APPARATUS OF SECOND EMBODIMENT

EXAMPLE OF RELATIONSHIP BETWEEN TONER LEVEL AND SENSOR ON-TIME IN TONER LEVEL DETECTOR OF SECOND EMBODIMENT

Tk : OPERATION TIME OF STIRRING BAR
Tsum : TOTAL OPERATION TIME OF STIRRING BAR

OPERATION FLOWCHART OF IMAGE FORMING APPARATUS OF SECOND EMBODIMENT

IMAGE FORMING CARTRIDGE, IMAGE FORMING APPARATUS AND TONER CARTRIDGE

CROSS REFERENCE TO RELATED APPLICATIONS

This application claims priority based on 35 USC 119 from prior Japanese Patent Application No. P2007-309602 filed on Nov. 30, 2007, the entire contents of which are incorporated herein by reference.

BACKGROUND OF THE INVENTION

1. Field of the Invention

The present invention relates to an image forming cartridge used in an electrophotographic printer, an electrophotographic copier and the like, and to an image forming apparatus.

2. Description of Related Art

A modern electrophotographic image forming apparatus generally forms an image in the following manner. First, the electrophotographic image forming apparatus exposes a surface of a photosensitive drum uniformly charged by a charging device with an exposure head, and thereby projects a desired image, character or the like onto the surface of the photosensitive drum to form an electrostatic latent image thereon. Then, the electrophotographic image forming apparatus develops the electrostatic latent image with toner in a triboelectrically charged image forming cartridge to form a toner image on the photosensitive drum, which serves as an image carrier, and thereafter transfers and fixes this toner image onto a medium.

In such an image forming apparatus, when a toner cartridge is replaced due to toner running low, a so-called fog noise is caused because new toner in the replaced new toner cartridge is not sufficiently charged. The fog noise is a phenomenon wherein toner particles attach to a portion that is not intended for developing. As a method for preventing this, Japanese Patent Application Publication No. 2002-258676 discloses a method of securing long times for triboelectrically charging toner in an image forming cartridge by incurring time to allow idling rotation of the image forming cartridge when a toner cartridge is replaced, for example.

However, in the above-described image forming apparatus of the related art, the extra time for idling rotation of the image forming cartridge is incurred every time and immediately after replacement of the toner cartridge. This prolongs stand-by time and subsequent print times.

SUMMARY OF THE INVENTION

An aspect of the invention provides an image forming cartridge that comprises: a developing unit configured to hold toner including: a developing section configured to use the toner for developing; and a supplying section configured to provide the toner to the developing section; and a toner cartridge attachable to the developing unit, wherein the toner cartridge contains toner and supplies toner to the developing unit, and the toner cartridge includes a stand-by charging unit configured to perform stand-by charge to the toner in the toner cartridge.

Another aspect of the invention provides an image forming apparatus that comprises: an image carrier; a developing unit, comprising an exposure unit configured to form an electrostatic latent image on the image carrier; and a developing unit that makes the electrostatic latent image visible;

a developer container attachable to the developing unit and configured to supply the developing unit with the developer, the developer container containing the developer; a replacement detector configured to detect replacement of the developer container; a stand-by charging unit configured to charge only the developer in the developer container; and a partition provided in a developer path from the developer container to the developing unit and configured to controllably open after stand-by charging of the developer upon detection of replacement of the developer container.

Another aspect of the invention provides a toner cartridge comprising: an identification storing unit configured to store data identifying the toner cartridge; a stirring unit configured to stir the toner in the toner cartridge, thereby charging the toner; and a conductive or semiconductive member configured to stand-by charge the toner, wherein the toner cartridge supplies the toner to a developing unit attachable to the toner cartridge after stand-by charging the toner in the toner cartridge.

BRIEF DESCRIPTION OF THE DRAWINGS

FIGS. 12A to 12D illustrate detection of amounts of toner in an image forming apparatus according to the second embodiment;

FIGS. 13A to 13D illustrate detection of amounts of toner in an image forming apparatus according to the second embodiment;

DETAILED DESCRIPTION OF EMBODIMENTS

Figure 1:
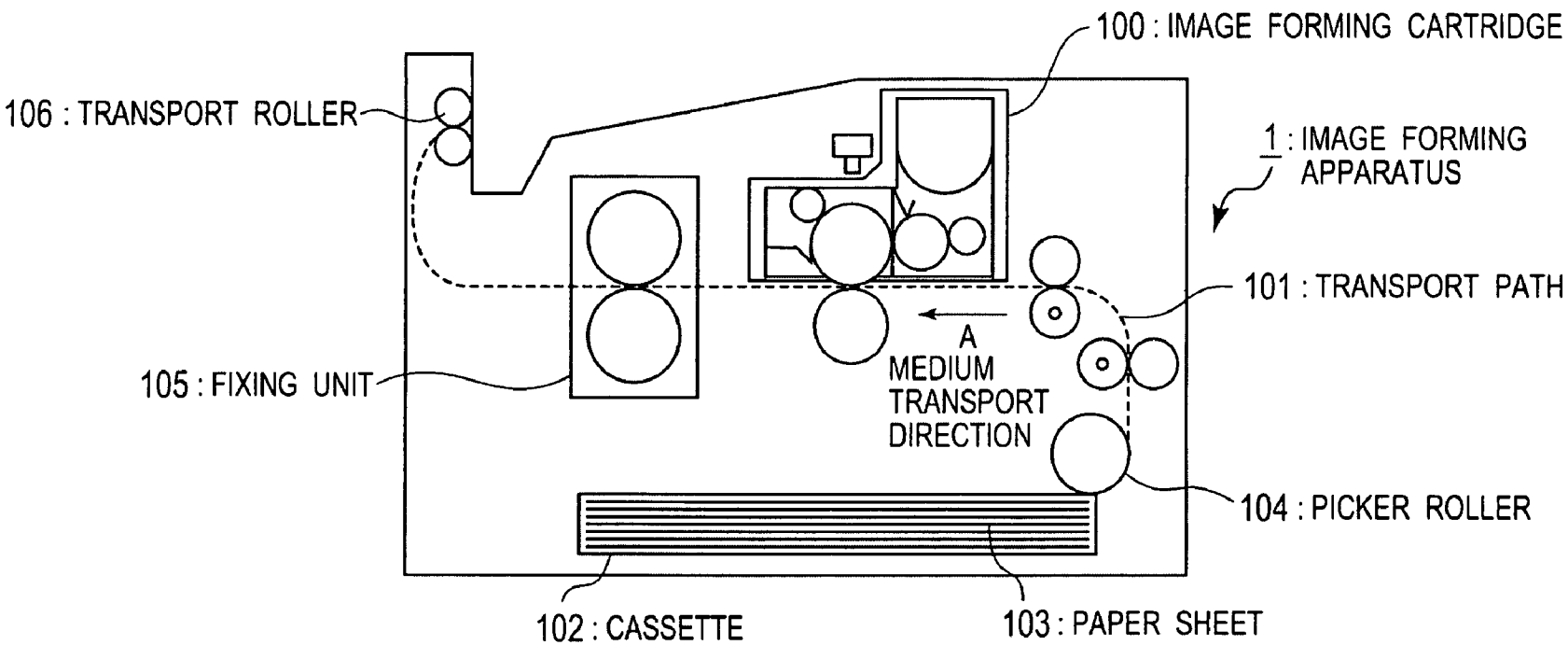
FIG. 1 is a configurational view of an image forming apparatus according to a first embodiment.

Embodiments of the invention will be described by referring to the drawings. In the drawings, the same reference numerals denote components that are common in the drawings. Note that, the invention will be described using a printing apparatus to exemplify an image forming apparatus, but is not so limited.

(Configuration)

Figure 2:
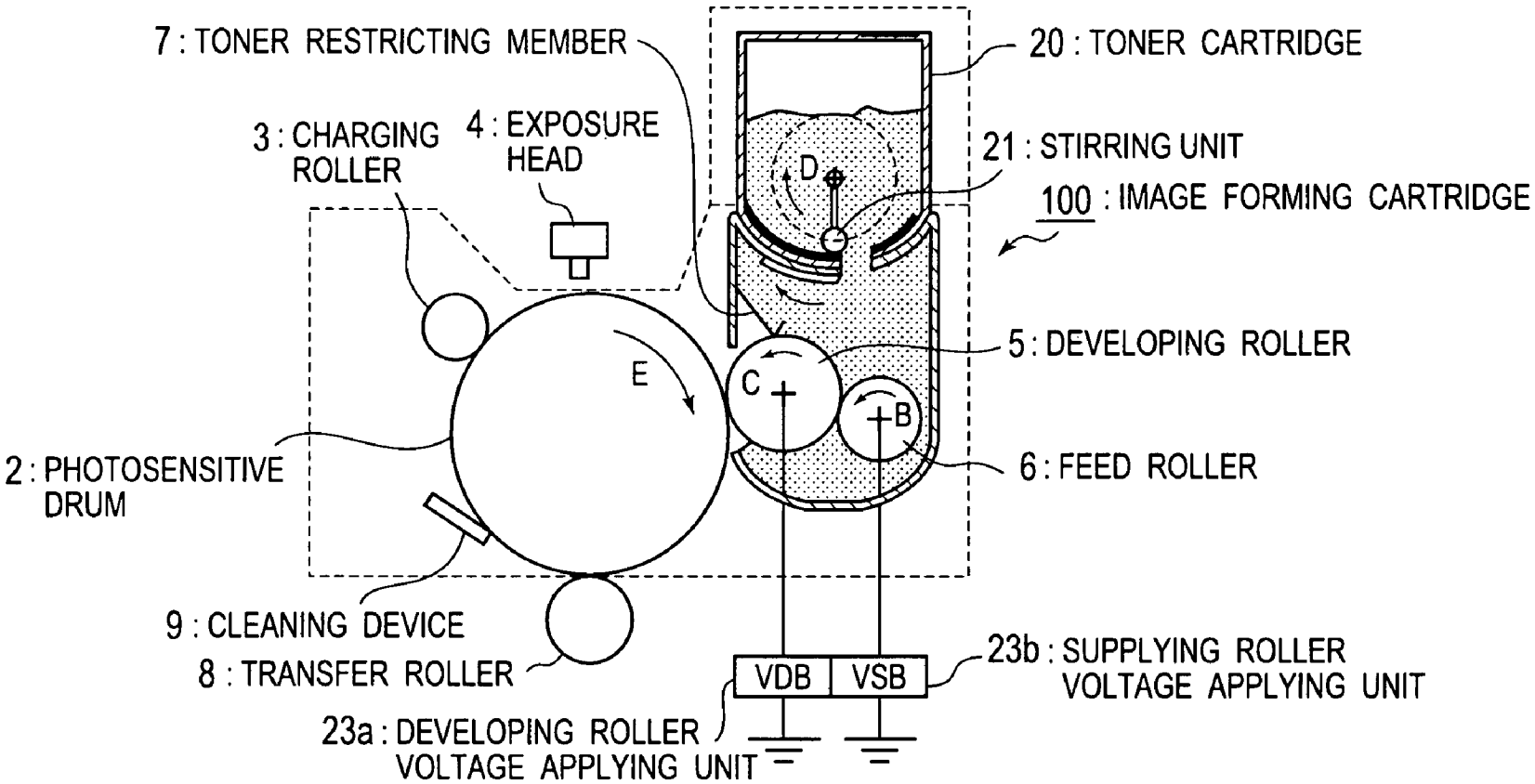
FIG. 2 is a configurational view of an image forming cartridge according to the first embodiment.
Figure 3:
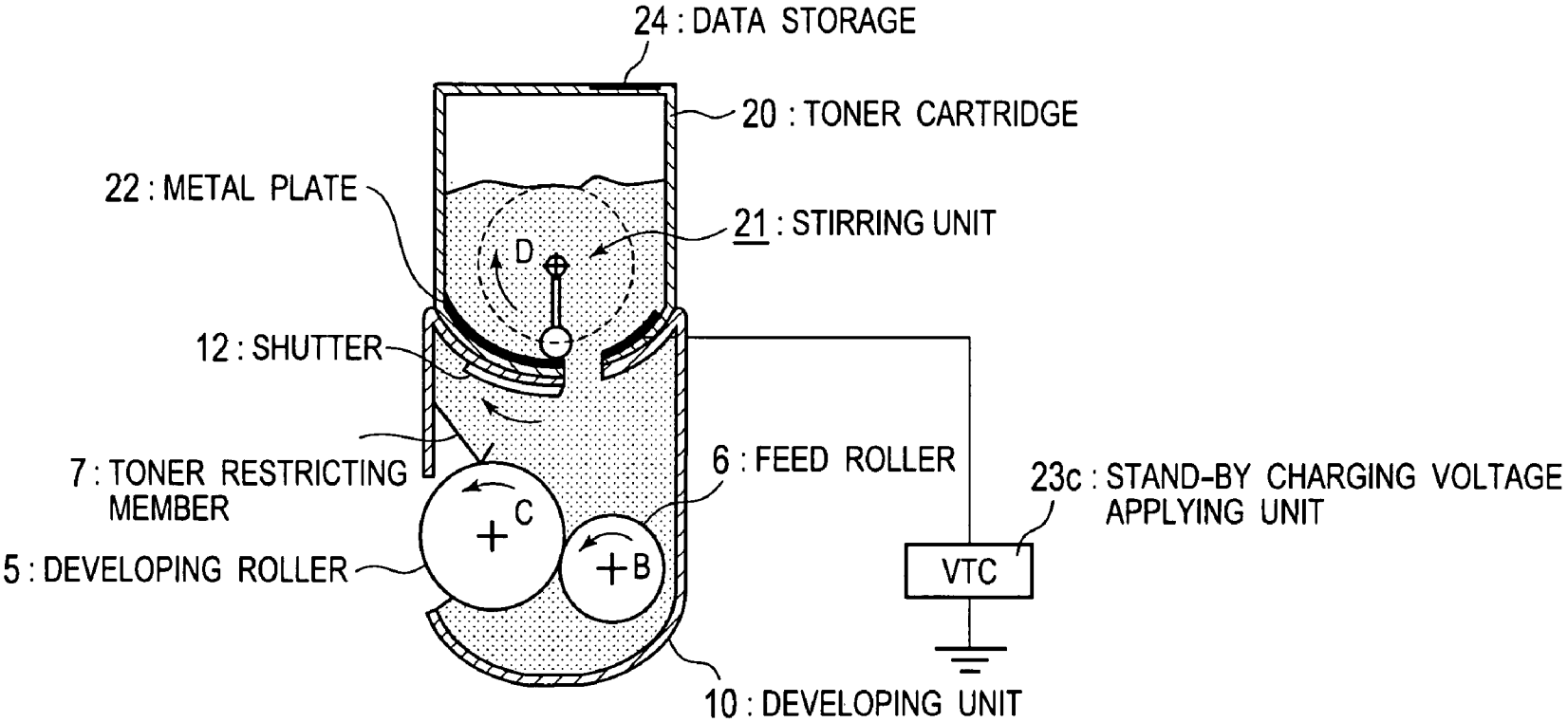
FIG. 3 is a cross-sectional view of a developing unit and a toner cartridge according to the first embodiment.

FIG. 1 is a configurational view of an image forming apparatus according to a first embodiment. FIG. 2 is a configurational view of an image forming cartridge. FIG. 3 is a cross-sectional view of a toner cartridge.

(Configuration of the Image Forming Apparatus)

First, as shown in FIG. 1, image forming apparatus 1 according to the first embodiment includes cassette 102 configured to store paper sheet(s) 103, picker roller 104 configured to send out paper sheets 103 one by one onto transport path 101, image forming cartridge 100 configured to perform toner development on paper sheet 103 transported as shown by arrow A, fixing unit 105 configured to thermally fix the toner development on paper sheet 103, and transport rollers 106 configured to send out paper sheet 103 on which the toner development is fixed, to the outside of image forming apparatus 1.

FIG. 2 shows a configuration of image forming cartridge 100 of image forming apparatus 1 according to the first embodiment and a peripheral portion thereof, including photosensitive drum 2, charging roller 3, exposure head 4, developing roller 5, feed roller 6, toner restricting member 7, transfer roller 8, and cleaning device 9.

Photosensitive drum 2 includes a conductive support and a photosensitive layer. The conductive support is an organic photoreceptor in which a charge generation layer and a charge transport layer are sequentially laminated as photoconductive layers on a metal pipe formed of aluminum. Charging roller 3 is formed of a metal shaft and a semiconducting rubber layer. Exposure head 4 functions to expose a surface of photosensitive drum 2 with LED light or laser light.

Developing roller 5 is formed of a metal shaft and a semiconducting urethane rubber member or the like. Feed roller 6 is formed of a metal shaft and a foamed urethane rubber member or the like. Toner restricting member 7 is a thin plate with, for example, a thickness of approximately 0.08 mm and a length in a longitudinal direction being substantially same as a width of an elastic body of developing roller 5. The toner restricting member 7 is provided so that one end in the longitudinal direction would be fixed to an unillustrated frame and the other end would come in contact with developing roller 5 on a surface slightly inside from the tip end.

Developing roller voltage supplying unit (23*a*) connects to developing roller 5. Feed roller voltage applying unit (23*b*) connects to feed roller 6. Both units are configured to charge respective rollers to a predetermined potential. In addition, an unillustrated voltage power supply is connected to charging roller 3 and transfer roller 8 so as to apply a predetermined voltage. These rollers rotate in directions shown by arrows B, C, and E in FIGS. 2 and 3 via motor (not shown) as a driving source under control of controller 32 shown in FIG. 5 described later.

(Configuration of the Developing Unit 10)

FIG. 3 shows a cross-sectional view of developing unit 10 and toner cartridge 20 of image forming cartridge 100 shown in FIG. 2. Developing unit 10 includes developing roller 5, feed roller 6, toner restricting member 7, and openable and closeable partition, such as shutter 12, provided on a toner path between toner cartridge 20 and developing unit 10. Image forming toner cartridge 100 may be attachable to and removable from image forming apparatus 1.

(Configuration of the Toner Cartridge 20)

Figure 4:
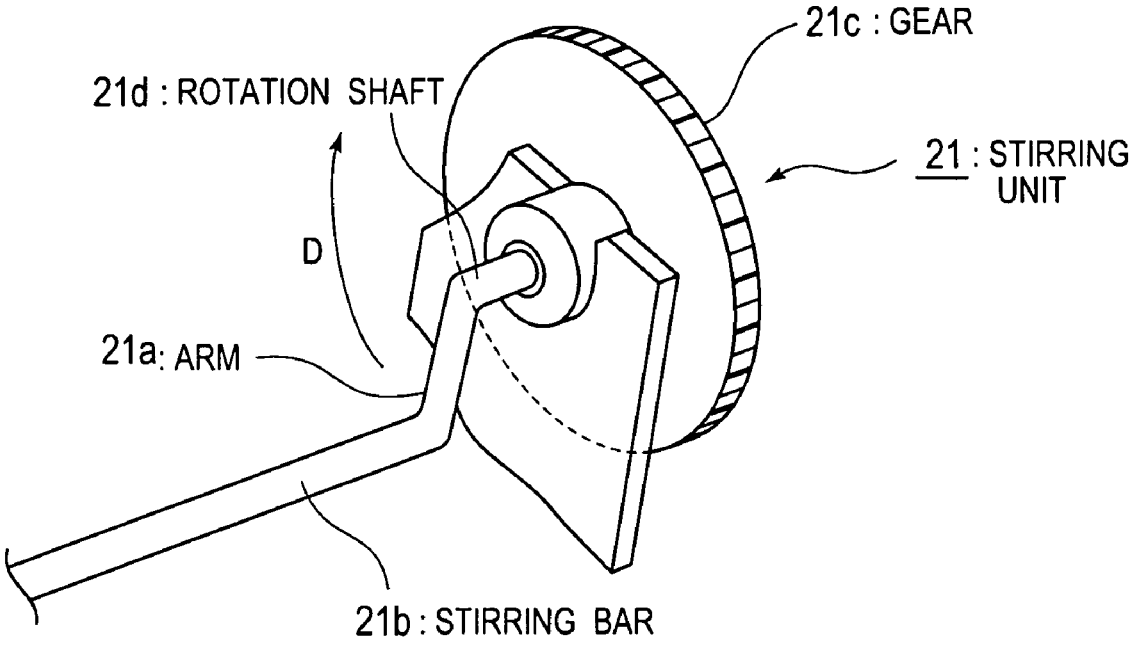
FIG. 4 is a configurational view of a stirring unit of the image forming apparatus according to the first embodiment.

On the other hand, toner cartridge 20 is a toner container that is attachable and removable to an upper portion of developing unit 10. Toner cartridge 20 includes stirring unit 21 configured to stir toner in the toner cartridge, a metal plate 22 being set so as to cover an inner wall surface, and data recorder 24, for example, a radio frequency identification (RFID) chip, in which information such as the product number of toner cartridge 20 is stored. Stand-by charging voltage applying unit VTC 23*c*, which may be included in image forming apparatus 1 is electrically connected to metal plate 22 to apply a voltage to metal plate 22. In addition, if toner cartridge 20 or image forming cartridge is attachable and removable, an interface for electrically connecting stand-by charging voltage applying unit VTC 23*c* and metal plate 22 may be provided in each of stand-by charging voltage applying unit VTC 23*c* and metal plate 22. FIG. 4 shows stirring unit 21 configured to stir the toner in toner cartridge 20. As shown in FIG. 4, stirring unit 21 is configured to rotate stirring bar 21*b* through arm 21*a*, under control of controller 32, by causing rotation shaft 21*d* to rotate with its rotation axis as center of rotation in the direction shown by arrow D through gear 21*c* driven by an unillustrated driving source. Note that, the driving source of developing roller 5 and feed roller 6 may be the same or different. Here, it is preferable that the driving source and controller 32 are provided to image forming apparatus 1. The stirring unit 21 may, of course, be directly rotated by a motor or the like without gear 21*c*, or the rotating direction may be reversed. Stirring bar 21*b* may, of course, have a plate form instead of a shaft form, or may have another form.

In addition, as long as a method promotes toner charging, the configuration is not limited to the combination of the above-described metal plate and stirring bar. The combination and the shape may be of any type, such as a metal blade and a rubber roller, or a mesh metal plate and a rubber roller, as long as at least one is a conductive material or semiconducting material.

(Configuration of the Control System)

Figure 5:
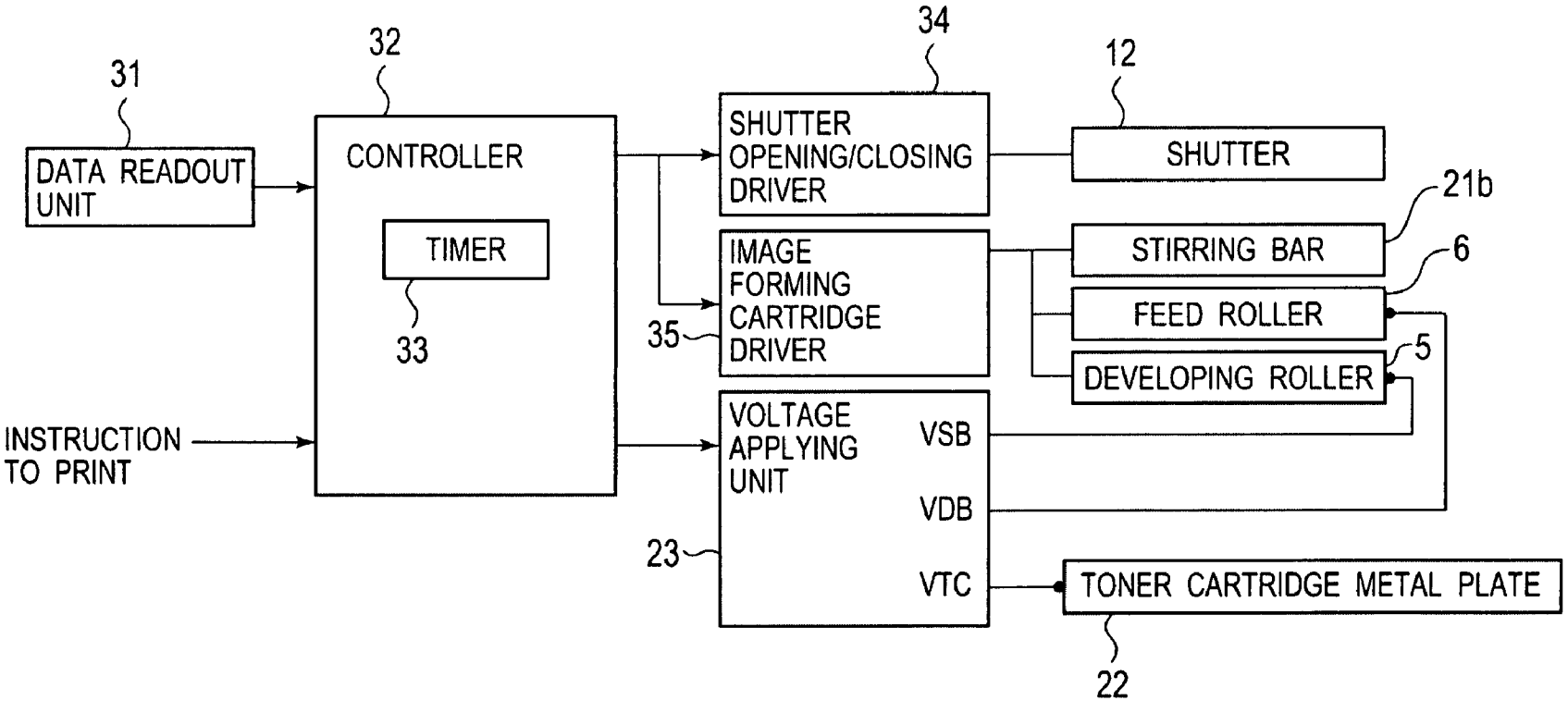
FIG. 5 is a configurational diagram of a control system of the image forming apparatus according to the first embodiment.

FIG. 5 is a block diagram of a control system for image forming apparatus 1 according to the first embodiment. Data readout unit 31 is a device configured to read out information stored in data recorder 24 included in toner cartridge 20 in a noncontact manner. Controller 32 gives an operation command to shutter opening/closing driver 34, image forming cartridge driver 35, and voltage applying unit 23 in response to a print instruction, and analyses data obtained from data readout unit 31. In addition, controller 32 has timer 33 configured to determine if a predetermined operation time of stirring bar 21*b* has expired.

Shutter opening/closing driver 34 opens shutter 12 through an unillustrated solenoid in response to an instruction from controller 32. In addition, image forming cartridge driver 35 drives developing roller 5, feed roller 6, and stirring bar 21*b* through an unillustrated motor in response to an instruction from controller 32. Voltage applying unit 23, which includes developing roller voltage apply init 23*a*, supply roller voltage applying unit 23*b* and stand-by charging voltage applying unit 23*c*, generates a high voltage for developing roller 5, feed roller 6, and metal plate 22 in the toner cartridge in response to an instruction from controller 32.

(Operations)

With the above-described configuration, image forming apparatus 1 according to the first embodiment will operate as follows. Image forming operations performed by this image forming apparatus 1 will be described with reference to the configurational views of FIGS. 1 and 2.

(Image Forming Operations)

First, a surface of photosensitive drum 2 is uniformly charged to an arbitrary polarity and potential by a charging device, such as charging roller 3 or the like. According to a print instruction from a higher-level device, image data outputted from an unillustrated writing controller is sent to exposure head 4. Then, an electrostatic latent image corresponding to an image pattern is formed on the surface of photosensitive drum 2.

Feed roller 6 to which a predetermined voltage is applied by feed roller voltage applying unit 23*b* comes in contact with developing roller 5. By rotationally driving feed roller 6, toner in a toner container of developing unit 10 is charged to a predetermined potential, and fed to developing roller 5.

The toner on developing roller 5 is triboelectrically charged by toner restricting member 7 coming in contact with developing roller 5. A thickness of the toner is determined by the pressing force of toner restricting member 7 onto developing roller 5. Developing roller 5 comes in contact with photosensitive drum 2 whose surface is charged by charging roller 3 to a predetermined voltage, and the toner charged by developing roller voltage applying unit 23*a* adheres onto the electrostatic latent image on photosensitive drum 2.

Then, under transport control of controller 32, the toner on photosensitive drum 2 is transferred by an electric field with transfer roller 8 onto paper sheet 103, which is send out by picker roller 104 and transported from the inside of cassette 102 through conveyance path 101. Thereafter, the transferred toner on paper sheet 103 is fixed by fixing unit 105 and discharged from a discharging port by transport rollers 106. Note that, the toner residual on photosensitive drum 2 is removed by cleaning device 9 after the transfer is completed.

In the above-described operations of image forming, when a toner level is sufficiently high in the toner container of developing unit 10 and there is no need to replace a toner cartridge, as shown in FIG. 2 or 3, toner cartridge 20 is set on the upper portion of developing unit 10 with shutter 12 open. Here, the toner in toner cartridge 20 and the toner in developing unit 10 are in a stirred state with set, desirable potentials. Thereby, a fog noise and the like caused by an insufficiently-charged new toner is avoided. Thus, an electrostatic latent image can be stably formed on photosensitive drum 2.

In contrast, when toner cartridge 20 is replaced, new toner in toner cartridge 20 is mixed into developing unit 10. Thereby, the electric potential of the toner in developing unit 10 is not at a desirable level. Thus, a fog noise and the like are created.

(Operations of Stand-By Charging)

To resolve such inconveniences, the image forming apparatus according to the first embodiment operates as follows. This operation will be described with reference to FIG. 6 in which shutter 12 is closed, with reference to FIG. 7 in which shutter 12 is opened.

First, when toner cartridge 20 is replaced, an unillustrated toner cartridge lock bar of toner cartridge 20 is rotated in a predetermined direction to manually close a shutter (not shown) of toner cartridge 20. Thereafter, toner cartridge 20 is pulled upward from the apparatus 1 and then detached. At that time, shutter 12, which is in the upper portion of developing unit 10, also is closed.

Figure 6:
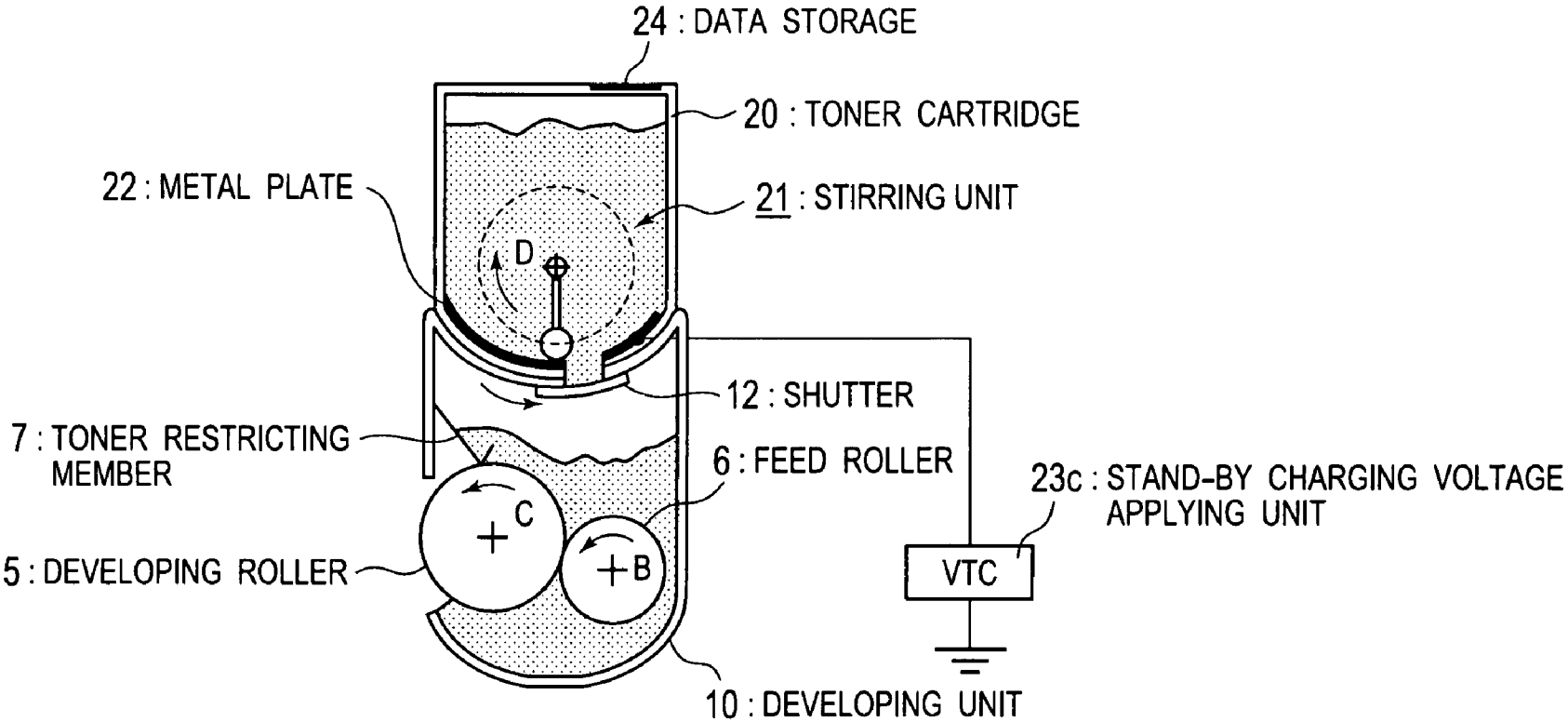
FIG. 6 is an operational illustration of the image forming apparatus according to the first embodiment.

Next, new toner cartridge 20 is inserted into image forming apparatus 1 and the unillustrated toner cartridge lock bar of toner cartridge 20 is rotated in a direction opposite to the direction in which the shutter is closed. Thereby, the shutter of toner cartridge 20 is opened. As shown in FIG. 6, when new toner cartridge 20 is placed, controller 32 reads out, for example, the product number of the new toner cartridge from data recorder 24 provided in the upper portion of toner cartridge 20, and detects that the product number before replacement is different from the new product number. Thereby, controller 32 detects that toner cartridge 20 is replaced.

Note that, the detection of whether toner cartridge 20 is replaced may be performed preferably when power to image forming apparatus 1 is turned on or when an unillustrated body cover of image forming apparatus 1 is closed after changing toner cartridge 20.

Next, when a printing instruction is made, developing unit 10 performs a regular printing operation. At the same time, toner cartridge 20 stirs toner by rotating stirring bar 21*b* of stirring unit 21 while voltage is applied to metal plate 22 via stand-by charging voltage applying unit 23*c*. Stirring bar 21*b* of stirring unit 21 rotates while coming into contact with metal plate 22, to which a voltage is applied by stand-by charging voltage applying unit 23*c*, so that stand-by charging to a developer is promoted.

At that time, shutter 12 remains closed. Thereby, only new toner in replaced toner cartridge 20 is independently stirred and charged without mixing with the toner in developing unit 10.

Voltage VTC applied from stand-by charging voltage applying unit 23*c* to metal plate 22 preferably may have the same polarity as the polarity of toner charging applied to developing roller 5 and feed roller 6. In addition, voltage VTC preferably may be substantially the same level as, for example, voltage VSB to be applied to feed roller 6.

Figure 7:
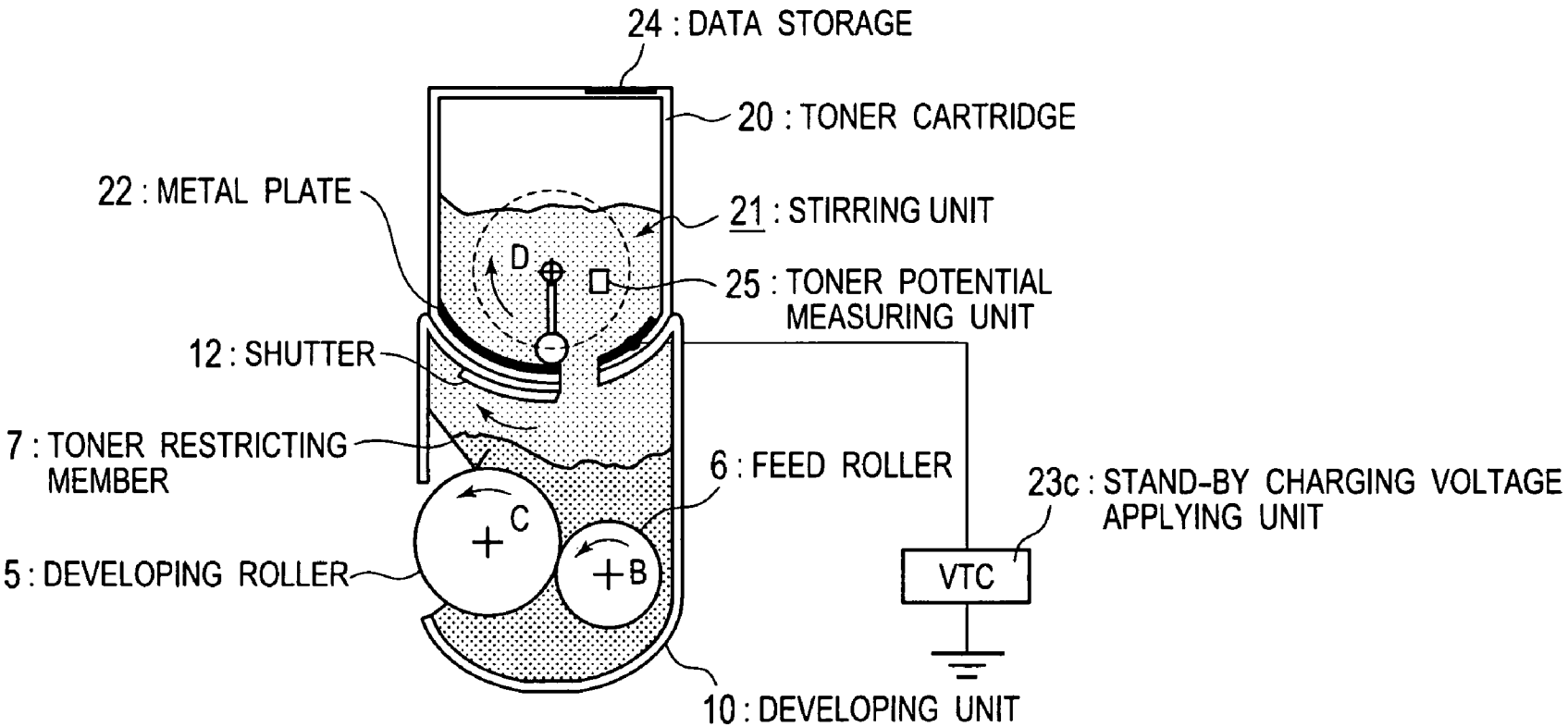
FIG. 7 is an operational illustration of the image forming apparatus according to the first embodiment.

Next, as for triboelectrically charging the toner in toner cartridge 20, a stirring operation is performed for a predetermined period and thereafter, as shown in FIG. 7, shutter 12 is opened by an instruction from controller 32. Then, the toner in toner cartridge 20 is put into developing unit 10 and mixed.

Note that, after shutter 12 is opened, it is better to terminate voltage to metal plate 22 to avoid deteriorating toner charging characteristics by unnecessarily increasing the toner charging amount in toner cartridge 20.

With the operations described above, the toner in toner cartridge 20 is mixed into the toner in developing unit 10. Thereby, a printing operation will proceed normally as shown in FIG. 2 or 3.

(Detailed Operations of Stand-By Charging)

Figure 8:
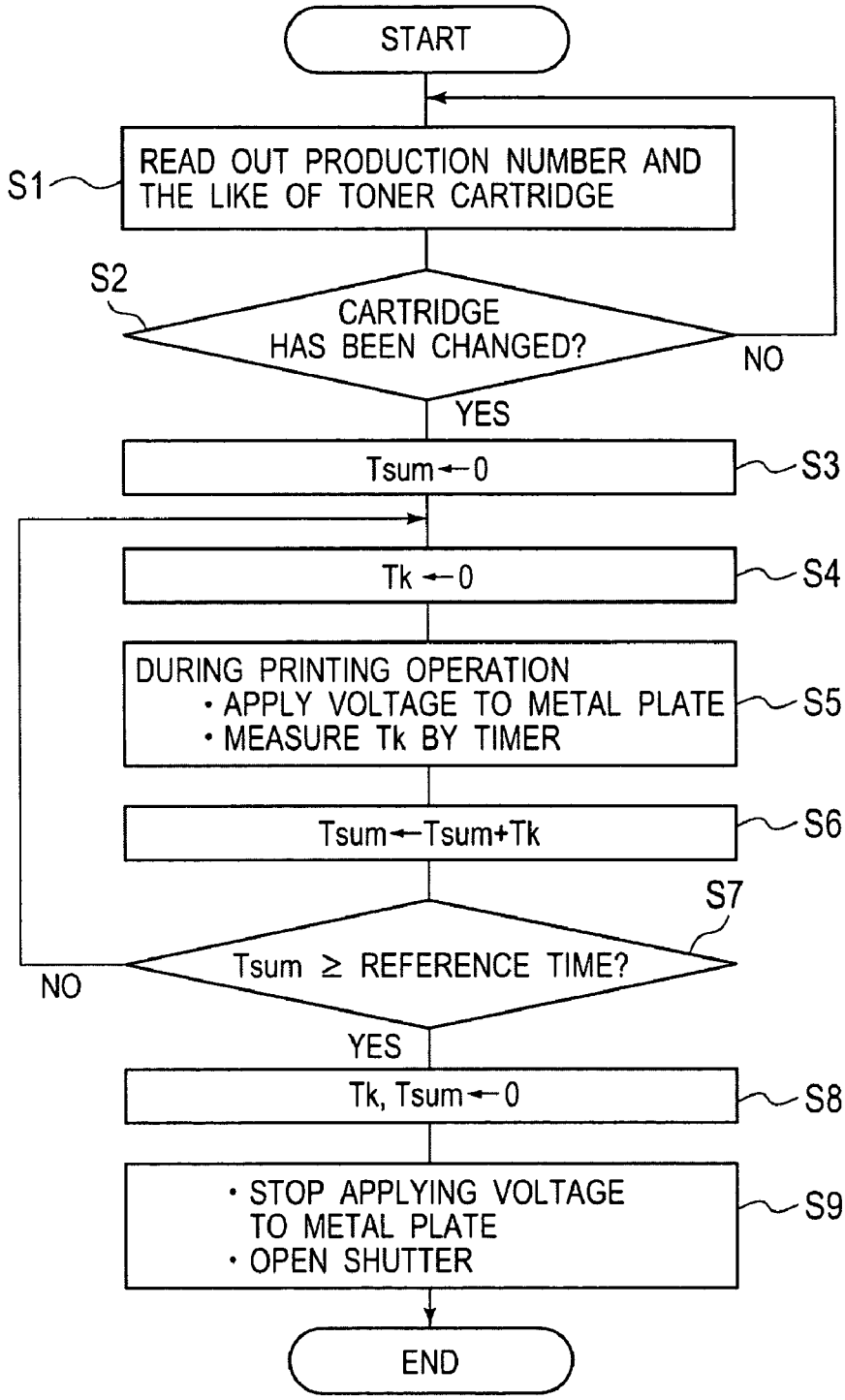
FIG. 8 is an operational flowchart of the image forming apparatus according to the first embodiment.

The above-described operations will be described in further detail with reference to the flowchart of FIG. 8. Note that the following description exemplifies the case wherein the driving source of stirring unit 21 is the same as the driving source of developing roller 5 or feed roller 6. In this example, stirring bar 21*b* can rotate only when printing is performed or at start-up, namely, when developing roller 5 or feed roller 6 rotates.

First, the product number of the toner cartridge or the like is read out from data recorder 24 (step S1) to determine whether toner cartridge 20 is changed (step S2).

Then, if it is determined that toner cartridge 20 is not replaced, the step returns to step S1 to repeat steps S1 and S2. A regular printing operation is performed during that time.

In contrast, if it is determined that toner cartridge 20 is replaced, a timer value of a total operation time Tsum of stirring bar 21*b* is cleared (step S3) and a timer value of an operation time Tk of stirring bar 21*b* in a series of printing operations is further cleared (step S4).

Then, measurement of the operation time Tk of stirring bar 21*b* in the series of printing operations is started, and a voltage is applied to metal plate 22 in toner cartridge 20 to start stand-by charging of the new toner in toner cartridge 20 (step S5).

After the series of printing operations are finished, the total operation time Tsum of stirring bar 21*b* is calculated (step S6), and controller 32 determines whether the total operation time Tsum exceeds a predetermined time (for example, one minute) (step S7).

When the total operation time Tsum does not reach the predetermined time, processes from steps S4 to S6 are repeated for every series of printing operations. When the total operation time Tsum reaches the predetermined time, it is determined that the toner in toner cartridge 20 is sufficiently triboelectrically charged. Thus, the timer values of the operation time Tk and the total operation time Tsum are cleared (step S8).

Thereafter, application of voltage to metal plate 22 in toner cartridge 20 terminates and shutter 12 opens, so that the toner in toner cartridge 20 and the toner in developing unit 10 would be mixed (step S9). Then, the process performed when the toner cartridge is replaced is finished.

In the description above, an example is described wherein the driving source of the rotation driver of stirring bar 21*b* is the same as the driving source of developing roller 5 and feed roller 6, and stirring bar 21*b* rotates only during the printing operations as in steps S3 to S6. However, when stirring bar 21*b* is rotationally driven by another driving source, stirring bar 21*b* can rotate regardless of the printing operations. Thus, shutter 12 may be opened after stirring bar 21*b* rotates for a reference period, which is set in advance.

In addition, the above-described embodiment describes the case wherein shutter 12 is opened based on a time in which stirring bar 21*b* rotates. However, shutter 12 may be opened based on, not the time, but, for example, a toner potential in the toner cartridge, which is detected by toner potential measuring unit 25 provided in toner cartridge 20. For example, the toner potential, which is charged by stirring in the toner cartridge 20 is measured by a general potential measuring method. When the measured potential reaches a predetermined value, shutter 12 may be opened by stopping the voltage application to metal plate 22. Note that, measurement of the potential merely requires a gold-plated electrode (with a diameter of approximately 6 mm) that is vibrated with a distance of several mm from a measuring surface. The surface potential at that time is measured by a vibration capacitance measurement.

In addition, the embodiment above describes the case wherein toner cartridge 20 is attachable and removable to developing unit 10 and thereafter stirring bar 21*b* rotates for charging the toner by stirring. However, toner cartridge 20 may be attachable and removable to developing unit 10 after becoming charged by stirring for a predetermined period by providing another charging device before being attached to developing unit 10.

Moreover, the embodiment above describes the case wherein the toner is charged by stirring by rotating stirring bar 21*b* via application of voltage to metal plate 22 for a predetermined period. However, if there is no need to uniformly charge the toner, voltage may be applied to metal plate 22 with time monitoring of steps S3 to S7, without rotating stirring bar 21*b*. Alternatively, Stand-by charging may be applicable by rotating stirring bar 21*b* in contact with metal plate 22 to stir toner in toner cartridge 20 instead of applying voltage to metal plate 22.

(Effects of the First Embodiment)

As described above, in the image forming apparatus according to the first embodiment, both the metal plate, which can carry out stand-by charging and the stirring unit are provided in the toner cartridge. Furthermore, the controllable shutter is provided in the developing unit at its junction portion with the toner cartridge. In this configuration, when the toner cartridge is replaced, the shutter is opened after completion of stand-by charging of the toner in the toner cartridge, which is independently charged from the toner in the developing unit. Accordingly, provision of a new idling time for charging the new toner by stirring is not required.

(Second Embodiment)

Figure 9:
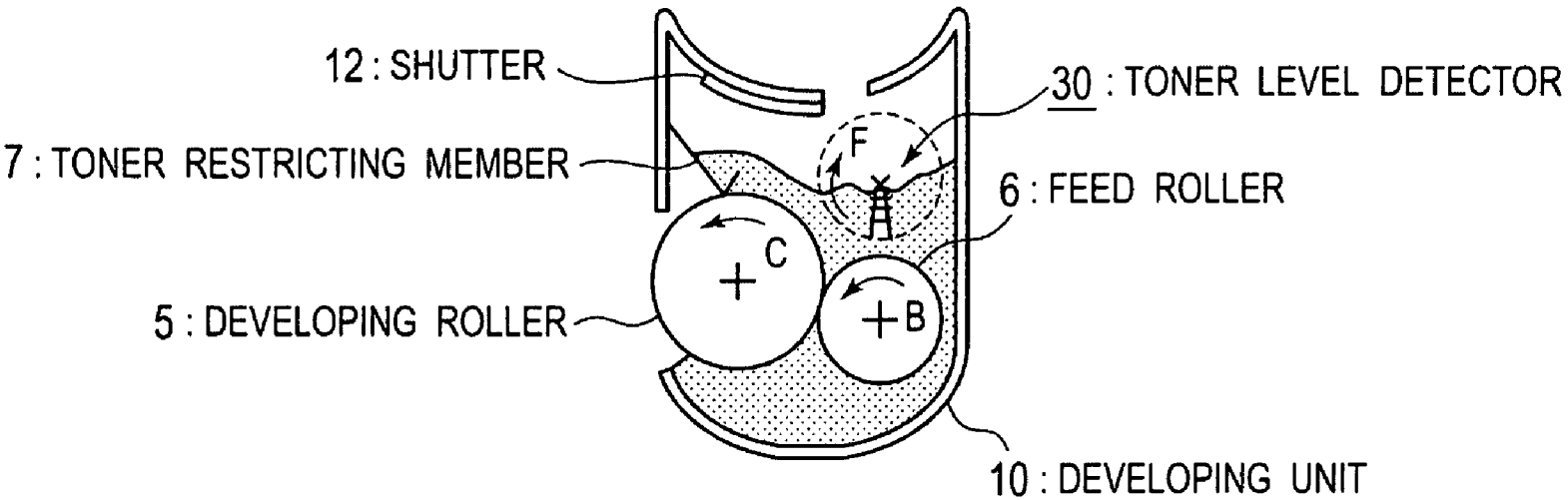
FIG. 9 is a cross-sectional view showing the configuration of a developing unit according to a second embodiment.

FIG. 9 shows the configuration of a developing unit according to a second embodiment as a cross-sectional view of developing unit 10. This second embodiment has and added toner level detector 30, which is configured to detect a residual amount of toner in developing unit 10. Other configurations are same as in the image forming apparatus according to the first embodiment, and the descriptions thereof are omitted for simplification.

(Configuration of Toner Level Detector)

Figure 10:
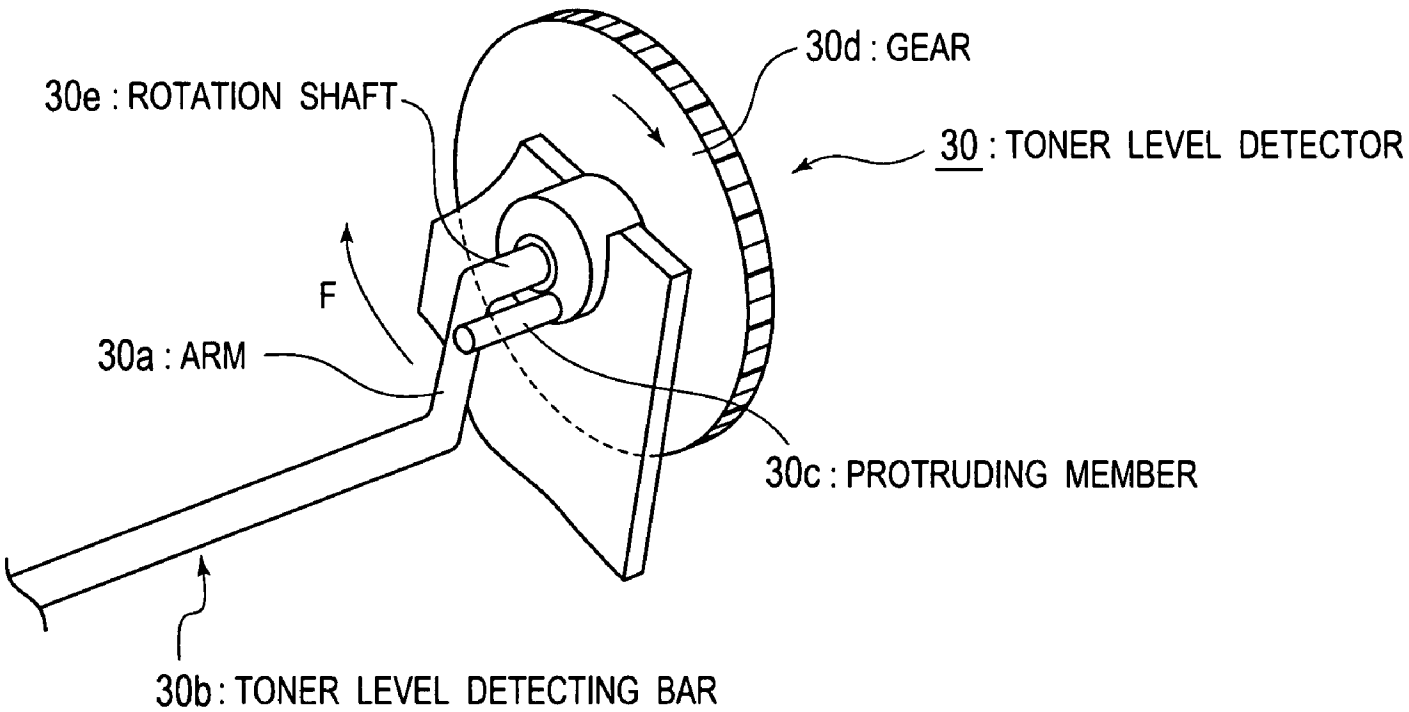
FIG. 10 is a view showing a toner level detector of an image forming apparatus according to the second embodiment.

FIG. 10 is a perspective view of toner level detector 30. As shown in FIG. 10, toner level detector 30 includes toner level detection bar 30*b* formed in the shape of a crankshaft, gear 30*d* rotated by an unillustrated driver, and protruding member 30*c* attached to gear 30*d*. Rotational shaft 30*e* of toner level detection bar 30*b* is engaged into the center portion of gear 30*d*, but is separately supported from gear 30*d*. Thereby, rotational shaft 30*e* can be rotated by being engaged in one direction in relation to gear 30*d*.

That is, when gear 30*d* rotates in the direction of arrow F in FIG. 10, protruding member 30*c* presses arm 30*a* of toner level detection bar 30*b* to cause toner level detection bar 30*b* to rotate in the direction of arrow F.

Note that, a driving source for rotationally driving developing roller 5 or feed roller 6 may be configured to rotate toner level detection bar 30*b*, like the driving source for driving stirring unit 21, or another driving source such as a motor may be provided for rotating toner level detection bar 30b.

(Configuration of the Control System)

Figure 11:
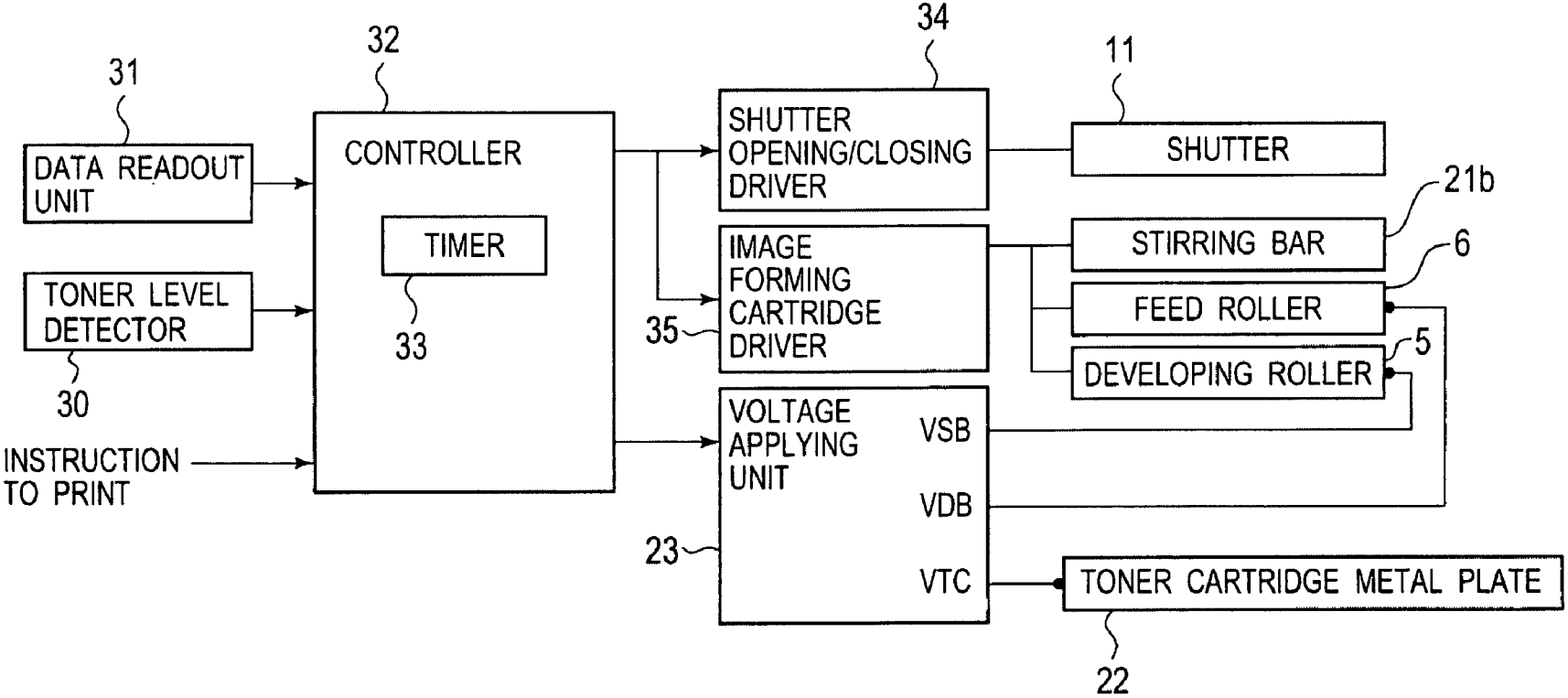
FIG. 11 is a configurational diagram of a control system of the image forming apparatus according to the second embodiment.

FIG. 11 is a configurational diagram of a control system of the image forming apparatus according to the second embodiment. As shown in FIG. 11, the control system of the image forming apparatus according to the second embodiment is configured to connect toner level detection unit 30 to controller 32. The toner level in developing unit 10 is detected by toner level detector 30 using a method to be described later and is inputted to controller 32.

Then, the charging by stirring performed by stirring bar 21 is made to the toner in the toner cartridge 20 in response to the toner level detection result from toner level detector 30. Thereafter, timer 33 in controller 32 measures whether a predetermined time has passed to control opening/closing of shutter 12.

(Operations)

First, the operation of toner level detector 30, which is configured to detect a toner level in developing unit 10, will be described in detail by referring to FIGS. 12A to 12D and FIGS. 13A to 13D.

(Operations of the Toner Level Detector)

These figures show operation of toner level detection bar 30*b* in respective cases where the residual amount of toner in developing unit 10 is high and where it is low. In toner level detector 30, toner level detection bar 30*b* is configured to drop by its own weight while rotating. The amount of toner amount is detected via a skip time due to changes in the drop due to the toner amount.

That is, consider a case where the level of residual amount of toner is high, as shown in FIGS. 12A and 12B. When gear 30*d* rotates in the F direction, toner level detection bar 30*b* rotates in the toner together with protruding member 30*c*. Thereafter, toner level detection bar 30*b* comes to the highest point as shown by the broken line in FIG. 12C. Then, only toner level detection bar 30*b* rotates due to its weight and drops at the position shown by the solid line in FIG. 12C.

After that, toner level detection bar 30*b* stops until protruding member 30*c* comes thereto as shown in FIG. 12D, and rotates by being pushed by protruding member 30*c* to return to the state shown in FIG. 12A.

When the residual amount of toner is low, as shown in FIGS. 13A and 13B, toner level detection bar 30*b* rotates together with protruding member 30*c*, and then comes to the highest point as shown by the broken line in FIG. 13C. Thereafter, only toner level detection bar 30*b* rotates due to its weight and drops as shown by the solid line in FIG. 13C. Here, toner level detection bar 30*b* stops in a position close to a substantially bottom portion until protruding member 30*c* comes thereto, and rotates again by being pushed by protruding member 30*c* to return to the state shown in FIG. 13A.

Based on the above-described operations of toner level detection bar 30*b*, toner level detection sensor 30*s*, such as a photointerrupter, provided under toner level detector 30 detects that toner level detection bar 30*b* is at a position close to the bottom portion and measures a detected duration.

Figure 14A:
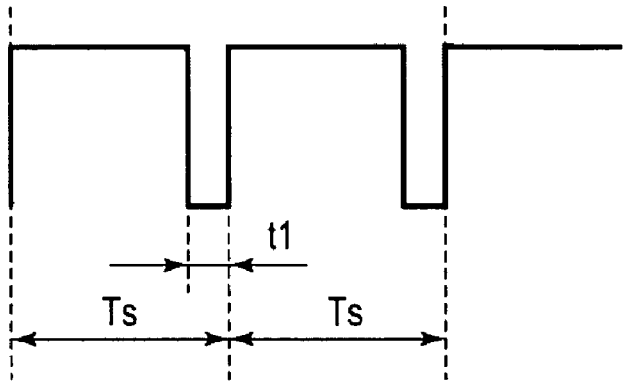
FIGS. 14A and 14B show sensor output waveforms from the image forming apparatus according to the second embodiment.
Figure 14B:
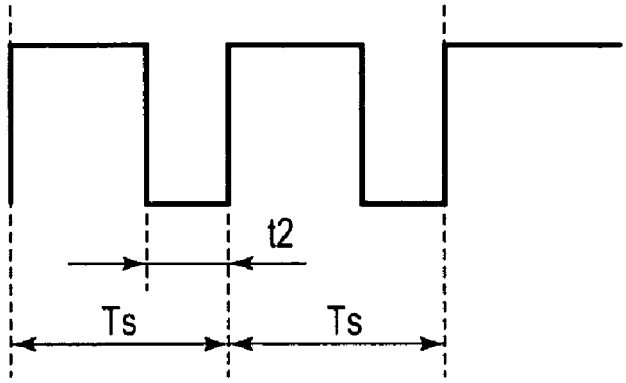

FIGS. 14A and 14B are output waveforms of toner level detection sensor 30*s*. In FIGS. 14A and 14B, Ts denotes a time period required for toner level detection bar 30*b* to make one rotation and each of t1 and t2 indicates the time period when sensor is turned on by toner level detection bar 30*b* passing by toner level detection sensor 30*s*. When the level of residual amount of toner is high, as shown in FIG. 14A, a sensor-on time of toner level detection sensor 30*s* is short (Low side), while when it is low, as shown in FIG. 14B, the sensor-on time of toner level detection sensor 30*s* is longer.

Figure 15:
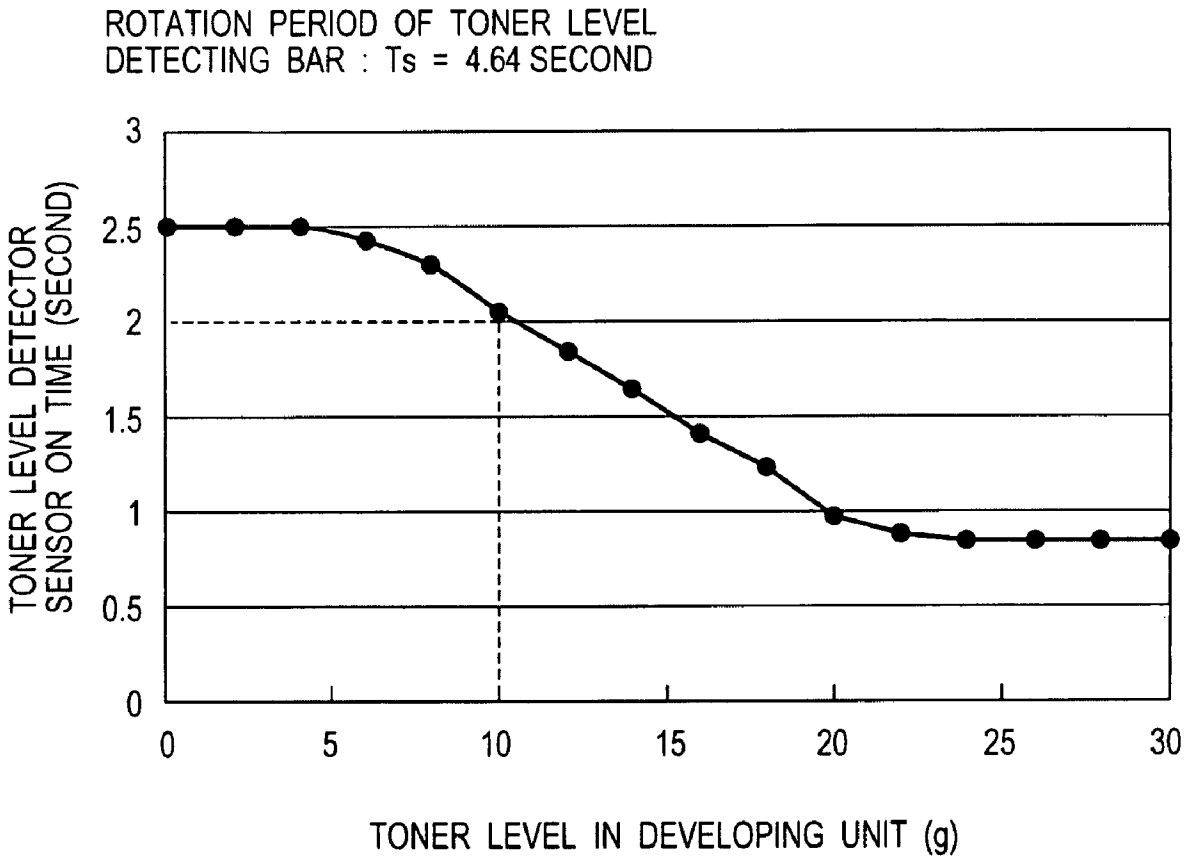
FIG. 15 exemplifies a relationship between toner level and sensor-on time of the toner level detector according to the second embodiment.

FIG. 15 is a graph in which a relationship between the residual amount of the toner in developing unit 10 and sensor-on time of toner level detector 30 is plotted. Here, the time period Ts required for the toner level detection bar to make one rotation is set to 4.64 seconds. As shown in FIG. 15, the sensor-on time gradually decreases as the residual amount of toner changes from approximately 5 g to approximately 20 g. It can be seen that, for example, the sensor-on time is approximately 2 seconds when the residual amount of the toner is 10 g.

As described above, the residual amount of toner in developing unit 10 can be detected from the sensor-on time of toner level detector 30, which varies depending on the residual amount of the toner.

(Operations of Stand-By Charging)

If shutter 12 is opened when the level of residual amount of the toner in developing unit 10 is low, a large amount of new toner enters developing unit 10 from toner cartridge 20. In contrast, if the level of residual amount of the toner in developing unit 10 is high, the amount of new toner entering developing unit 10 from toner cartridge 20 is small even if shutter 12 is opened.

Accordingly, consider a case where the level of residual amount of the toner in developing unit 10 is high, and the toner in toner cartridge 20 is mixed into developing unit 10 without stand-by charging. Here, if the mixed new toner is accumulated in a portion far above developing roller 5, for example if the new toner is mixed in a range of approximately 5 mm below shutter 12, toner to be consumed for image forming can be supplemented by the toner in developing unit 20, which is sufficiently charged. Thus, an effect of a fog noise on a printed image is small.

However, if the level of residual amount of toner in developing unit 10 is low and the upper portion of developing roller 5 protrudes from the toner accumulation, the new toner mixed from toner cartridge 20 is soon used for image formation. Thus, the effect of fog noise on a printed image is increased.

Judging from the foregoing description, the lower the level of residual amount of the toner in developing unit 10, the greater the need for sufficiently electrostatically charging new toner mixed from toner cartridge 20

For this reason, the image forming apparatus according to the second embodiment is configured so that when toner cartridge 20 is replaced, toner level detector 30 detects the residual level the toner in developing unit 10. This detected amount is compared with a reference amount that is set in advance. Then, if the residual level of toner is equal to or less than the reference amount, the toner in toner cartridge 20 is charged by stirring.

(Detailed Operations of Stand-By Charging)

Figure 16:
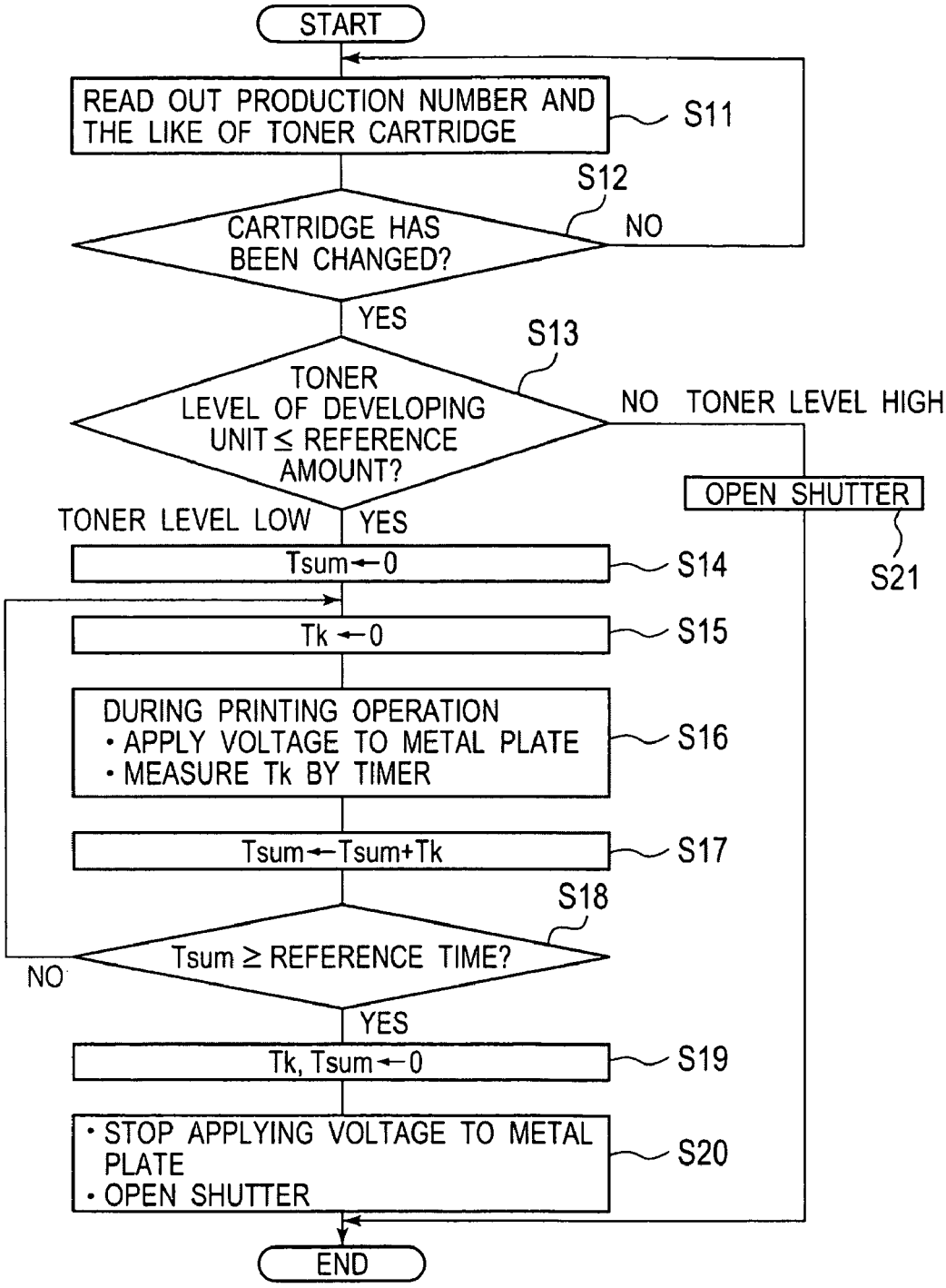
FIG. 16 is an operational flowchart of the image forming apparatus according to the second embodiment.

The operations of stand-by charging will be described in detail below by referring the operational flowchart in FIG. 16. Note that, steps S11, S12, and S14 to S20 are substantially the same as those of the first embodiment, and the descriptions thereof are omitted.

First, toner cartridge data is read from data recorder 24 (step S11). Then, controller 32 determines whether toner cartridge 20 is replaced (step S12). If the toner cartridge is found not replaced, the step returns to step S11 to repeat steps S11 and S12. For that time, a regular printing operation is performed.

In contrast, if the toner cartridge is found replaced, the level of residual amount of the toner in developing unit 10 is detected by toner level detector 30, and it is determined whether the detected residual amount is equal to or less than the toner level reference value, which is set in advance (step S13).

For example, when the reference value of the residual amount of the toner is 10 g, 2 seconds is set as a reference time for sensor-on when the residual amount of the toner is 10 g. Then, the detected sensor-on time is compared with the reference time. If the sensor-on time is shorter than the reference time, it is determined that the residual amount of the toner is larger than 10 g. In contrast, if the sensor-on time is longer than the reference time, it is determined that the residual amount of the toner is smaller than 10 g.

If it is determined by the above-described determination method that the residual amount of the toner in developing unit 10 is larger than the reference value, then shutter 12 is opened without charging the toner in toner cartridge 20 by stirring with stirring unit 21 (step S21). Then, the process is completed to perform a regular printing operation.

In contrast, if it is determined that the residual amount of the toner in developing unit 10 is small, the timer value of total operation time Tsum of stirring bar 21*b* and the timer value of operation time Tk of stirring bar 21*b* in a series of printing operations are cleared (steps S14 and S15).

Then, measurement of the operation time Tk of stirring bar 21*b* in the series of printing operations is started, and a voltage is applied to metal plate 22 in toner cartridge 20 to start stand-by charging of new toner in toner cartridge 20. If the series of printing operations are finished, a total operation time Tsum of stirring bar 21*b* is calculated. After that, it is determined whether total operation time Tsum exceeds the reference time, which is set in advance, for example, approximately one minute (steps S16 to S18).

If total operation time Tsum does not reach the reference time, processes from steps S15 to S17 are repeated for each series of printing operations. If it is determined that total operation time Tsum reaches the reference time, then the toner in toner cartridge 20 is deemed sufficiently electrostatically charged. Thus, the timer values of operation time Tk and total operation time Tsum are cleared. After that, voltage application to metal plate 22 in toner cartridge 20 is terminated to open shutter 12. Thereby, the toner in toner cartridge 20 and the toner in developing unit 10 are mixed (steps S19 and S20). Then, the current process is completed.

Note that, in the above-described second embodiment, only one reference value for residual amount of toner in developing unit 20 used in step S13 is provided as a determination reference for determining whether electrostatic charging is performed before the new toner in toner cartridge 20 is mixed into the toner in developing unit 10. However, multiple reference values can be set for the residual amount of toner. An electrostatic charging time of the new toner in toner cartridge 20 by stirring is changed depending on the residual amount of the toner in developing unit 10 by changing the reference time of the total operation time Tsum of stirring bar 21*b* for each reference value.

In addition, in the description of the embodiment above, a method for detecting residual amount of toner is described by using, as an example, the method for detecting residual amount of the toner in developing unit 10 by utilizing sensor-on time of toner level detector 30, which changes according to the residual amount of toner. However, other toner level detection methods, such methods for detecting toner weight, or the like may be used.

(Effects of the Second Embodiment)

As described above, in the image forming apparatus according to the second embodiment, the toner level detector configured to detect the level of residual amount of the toner in developing unit is provided to detect a residual amount of the toner by the toner level detector when a toner cartridge is replaced. The stand-by charging time of the new toner in the toner cartridge changes based on the detected residual amount of toner. Thereby, an optimum stand-by time can be set. Thus, deterioration of toner charging characteristics can be prevented by greatly increasing the amount of toner charging.

The present invention is widely applicable to image forming apparatuses, such as multifunctional printers, facsimiles, copiers, and the like, in addition to electrophotographic printers.

The image forming apparatus according to the present embodiment includes a replacement detector configured to detect replacement of a developer container, a stand-by charger configured to perform stand-by charging on only a developer in the developer container, and a partition, which is provided on a developer path from the developer container to the developing unit and which is controlled to open and close. In addition, the image forming apparatus is configured for opening of the partition after the stand-by charging unit performs the stand-by charging on the developer in the developer container when the replacement detector detects that the developer container is replaced. Accordingly, there is no need to provide a new idling time for charging the new toner by stirring.

As described above, the image forming cartridge and image forming apparatus according to the present embodiment can suppress the generation of fog noise and shorten waiting time for printing even when the toner cartridge is replaced.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image forming cartridge, comprising:

a developing unit including:

a developing section configured to use toner for developing; and a supplying section configured to provide the toner to the developing section;

a toner cartridge containing toner, wherein the toner cartridge includes a stand-by charging unit configured to perform stand-by charge to the toner in the toner cartridge; and a shutter capable of opening and closing a path from the toner cartridge to the developing unit; wherein stand-by charging of the toner in the toner cartridge is started in the state where the path is closed with the shutter and the path is opened with the shutter when a predetermined period elapses from the start of the stand-by charging.

2. The image forming cartridge of claim 1, wherein the toner cartridge is configured to be detached from and attached to the developing unit, and the stand-by charging of the toner in the toner cartridge is terminated, when the predetermined period elapses from the start of the stand-by charging.

3. The image forming cartridge of claim 1, wherein the toner cartridge comprises a stirring unit configured to stir the toner in the toner cartridge.

4. The image forming cartridge of claim 3, wherein the controller opens the path when the stirring unit stirs the toner a predetermined number of times or for a predetermined period after the start of the stand-by charging.

5. The image forming cartridge of claim 1, wherein the toner cartridge comprises a toner voltage sensor configured to measure a potential of the toner in the toner cartridge, and the path is opened when a voltage detected by the voltage measuring unit reaches a predetermined voltage after the start of the stand-by charging.

6. The image forming cartridge of claim 1, wherein the stand-by charging unit comprises a conductive or semiconductive member configured to stand-by charge the toner.

7. The image forming cartridge of claim 6, wherein the conductive member includes a metal plate.

8. The image forming cartridge of claim 7, wherein the toner is charged by rotation of the stirring unit while voltage is applied to the metal plate.

9. The image forming cartridge of claim 1, wherein the developing unit includes a toner level detector configured to detect a residual amount of the toner in the developing unit, and upon detection of the residual toner amount in the developing unit below a predetermined amount, stand-by charging of the toner in the toner cartridge is activated.

10. The image forming cartridge of claim 9, wherein the toner level detector includes a toner level detection bar in the form of a crankshaft;

a gear rotated by a force from outside the cartridge; and a protruding member connected to the gear, wherein the residual amount of the toner is detected by determining the drop time of the toner level detection bar as activated by a push from protruding member on the rotated gear.

11. An image forming apparatus, comprising:

an image carrier;

an exposure unit configured to form an electrostatic latent image on the image carrier;

a developing unit that makes the electrostatic latent image visible;

a developer container attachable to the developing unit and configured to supply the developing unit with the developer, the developer container containing the developer;

a replacement detector configured to detect replacement of the developer container;

a stand-by charging unit configured to charge only the developer in the developer container;

a partition provided at a developer path from the developer container to the developing unit and configured to close and open the developer path; and a controller configured to start stand-by charging of the toner in the toner cartridge in the state where the developer path is closed with the shutter and to open the developer path with partition when a predetermined period elapses from the start of the stand-by charging of the toner in the toner cartridge.

12. The apparatus of claim 11, further comprising a residual developer indicator configured to detect residual developer in the developing unit, and wherein the detected amount of residual developer changes the duration of stand-by charging upon detection of developer container replacement.

13. The apparatus of claim 12, wherein the duration of stand-by charging is set only when the detected residual developer is at or below a predetermined reference value.

14. The apparatus of claim 11, wherein the stand-by charging is performed only when the partition is closed.

15. A toner cartridge comprising:

an identification storing unit configured to store data identifying the toner cartridge;

a stirring unit configured to stir the toner in the toner cartridge, thereby charging the toner;

a conductive or semiconductive member configured to stand-by charge the toner; and a path connecting the inside and the outside of the toner cartridge, wherein stand-by charging of the toner in the toner cartridge is started in the state where the path is closed and the path is opened when a predetermined period elapses from the start of the stand-by charging.

16. The toner cartridge of claim 15, wherein the conductive member includes a metal plate.

17. The toner cartridge of claim 15, wherein the stirring unit comprises:

a gear electrically controlled by a driving source; and a stirring bar connected to the gear and configured to stir the toner in the toner cartridge by rotation.

18. An image forming apparatus, comprising a developing unit including:

a feed roller configured to charge toner by rotating;

a developing roller configured to supply toner to a photosensitive drum connectable to the developing unit;

a toner restricting member in contact with the developing roller, configured to restrict the amount of toner on the developing roller; and a shutter configured to open and close a path from a toner cartridge to the developing unit; and a controller configured to start stand-by charging of toner in the toner cartridge in the state where the path is closed with the shutter and to open the path with the shutter when a predetermined period elapses from the start of the stand-by charging.

19. The apparatus of claim 18, further comprising:

a charging roller charged to a predetermined voltage;

a photosensitive drum configured to receive toner from the developing member, the surface of the photosensitive drum being charged by the charging roller; and a cleaning member configured to remove toner on the photosensitive drum.

20. The cartridge of claim 1, further comprising:

a charging roller charged to a predetermined voltage;

a photosensitive drum configured to receive toner from the developing section, the surface of the photosensitive drum being charged by the charging roller; and a cleaning member configured to remove toner on the photosensitive drum.

21. The cartridge of claim 1, further comprising a stand-by charging voltage applying unit configured to apply a voltage to the stand-by charging unit.

* * * * *